US005201328A

United States Patent [19]

Blaffert et al.

[11] Patent Number: 5,201,328

[45] Date of Patent: Apr. 13, 1993

[54] METHOD AND APPARATUS FOR THE PRODUCTION OF COAXIAL TOBACCO OR FILTER RODS AND COAXIAL TOBACCO OR FILTER ROD MADE BY SAID METHOD

[75] Inventors: Otto Blaffert, Schenefeld; Meinhard Meyer, Appen-Unterglinde; Herbert Struck, Wedel; Arno Weiss, Norderstedt, all of Fed. Rep. of Germany

[73] Assignee: B.A.T. Cigarettenfabriken GmbH, Hamburg, Fed. Rep. of Germany

[21] Appl. No.: 666,771

[22] Filed: Mar. 8, 1991

[30] Foreign Application Priority Data

Mar. 26, 1990 [DE] Fed. Rep. of Germany ..... 4009657

[51] Int. Cl.[5] ..... A24C 5/14

[52] U.S. Cl. ..... 131/84.1; 131/94

[58] Field of Search ..... 131/84.1, 94

[56] References Cited

U.S. PATENT DOCUMENTS 4,727,888 3/1988 Luke ..... 131/84.1

FOREIGN PATENT DOCUMENTS 2015387 12/1970 Fed. Rep. of Germany .
7904002 6/1979 Fed. Rep. of Germany .
3602846 8/1986 Fed. Rep. of Germany .

*Primary Examiner*—V. Millin
*Assistant Examiner*—J. Doyle
*Attorney, Agent, or Firm*—Armstrong, Westerman, Hattori, McLeland & Naughton

[57] ABSTRACT

The invention relates to a method and an apparatus for the production of a coaxial tobacco or filter rod, a first production machine processing a strip-like first covering material and a stream of filling material to give a preformed rod which is deposited in a special magazine in order to be removed again therefrom in due course and supplied to a second production machine which brings the preformed rod together with a stream of filter or smoking material and a strip-like second covering material and processes it to form the coaxial tobacco or filter rod.

30 Claims, 4 Drawing Sheets

METHOD AND APPARATUS FOR THE PRODUCTION OF COAXIAL TOBACCO OR FILTER RODS AND COAXIAL TOBACCO OR FILTER ROD MADE BY SAID METHOD

BACKGROUND OF THE INVENTION

1. Field of the Invention

The invention relates to a method and an apparatus for the production of coaxial tobacco or filter rods and to a coaxial tobacco or filter rod made by said method.

2. Description of the Prior Art

A method of this type for producing a cigarette is known from DE-OS 3,602,846. Firstly, an inner rod of filling material and a sheath of strip-like material are preformed. The preformed rod is supplied to the format of a cigarette making machine and there enclosed with a web of an outer covering material and a stream of smoking material. Both the preformed rod and the resultant coaxial rod are made in separate rod-forming machines arranged directly one after the other.

The known method has the disadvantage that on disturbances in one of the rod-forming machines it is always necessary to shut down both rod-forming machines. This grossly reduces the overall efficiency.

SUMMARY OF THE INVENTION

The invention is thus based on the objective of substantially overcoming the aforementioned disadvantages of the prior art; in particular, it is the objective of the invention to provide a method and an apparatus with which coaxial tobacco or filter rods can be made with a substantially greater efficiency.

The invention therefore proposes in a method for producing coaxial tobacco or filter rods in which a first production machine, in particular a first rod-forming machine, forms a preformed rod from a strip-like first covering material and a stream of filling material and a second production machine, in particular a second rod-forming machine, forms from the prefabricated rod, a strip-like second covering material and a stream of filling material, the coaxial tobacco or filter rod, the improvement in which the preformed rod coming from the first production machine is intermediately stored before it is further processed in the second production machine.

The invention also proposes in an apparatus for the production of a coaxial tobacco or filter rod comprising a first production machine, in particular a first rod-forming machine for producing a preformed rod from a strip-like covering material and a filling material and a second production machine, in particular a second rod-forming machine, for bringing together and processing the preformed rod with a strip-like second covering material and a stream of filter or smoking material to give the coaxial tobacco or filter rod, the improvement in which between the first production machine and the second production machine a preferably rotation-symmetrical magazine for the prefabricated rod is arranged.

Expedient method variants and embodiments are defined by the features in the subsidiary claims.

If a preformed rod or skein coming from the first production machine is deposited in a magazine in order to be taken from the magazine again in due course and further processed in the second production machine to give the coaxial smokable article, an uncoupling of the two production machines is possible and this leads to a decisive increase in the total efficiency of the two production machines, which will be referred to hereinafter as rod-forming machines.

In a particularly simple method variant the preformed rod may be deposited independently solely under gravity in the magazine which is turned about its longitudinal axis.

If the preformed rod is deposited spirally in layers, the subsequent discharging of the preformed rod from the magazine is substantially facilitated in so far as by avoiding intertwinings or rod convolutions of a layer lying crosswise over each other tearing of the preformed rod is prevented and natural oscillations of the rod reduced.

To additionally ensure the ordered deposition of the preformed rod in the magazine it is advantageous to raise the preformed rod via deflection means, in particular deflection rollers and/or transport rollers, in such a manner that the preformed rod can be lowered from above into the magazine.

To adapt the deposition length of the preformed rod per magazine rotation dependent on the instantaneous deposition radius to the production rate of the first rod-forming machine it is advantageous for a control means to be present with which the rotational speed of the magazine can be controlled in such a manner that on deposition near the magazine axis the magazine rotates faster whilst with increasing deposition radius it rotates slower and vice-versa.

To enable different diameters of the prefabricated rod to be deposited orderly in the magazine it is advantageous for the control means to make the radius-dependent change of the rotational speed of the magazine additionally dependent on the diameter of the prefabricated rod. This has the advantage that the method according to the invention can be used with even greater versatility.

The preformed rod can be deposited in the magazine in still more orderly manner if it is introduced into the magazine in such a way that the deposition region in the magazine corresponds to a theoretically calculated instantaneously valid point of a spiral in the magazine, the calculation parameters for the spirals consisting inter alia of the rod thickness, the minimum and maximum diameters of the magazine and the deposition velocity. The deposition device may comprise an arm which is driven by a motor and mounted displaceably along the radius of the magazine and which is provided with a guide rail. The motor drive of the arm is supplied with control pulses by a control means.

During the loading, a body is provided in the magazine which can subsequently be removed therefrom. This then results in a cavity via which a subsequent unloading operation can easily be carried out. This avoids the rod being laid out with too small a radius, which could lead to tearing or breakage thereof. This body therefore serves as a sort of coil core.

During the discharging the magazine may be operated substantially with constant rotational speed, although of course changing rotational speeds may also be employed. Natural oscillations occurring during unloading are not as relevant as during loading of the magazine because said natural oscillations are largely absorbed by the transport means in front of the second rod-forming machine.

To further eliminate the natural oscillations of the prefabricated rod led out of the magazine the rod is removed from the magazine via a guide arranged above said magazine. The guide may consist of a hollow cylinder which tapers conically towards the centre and from the centre onwards again widens and which can "wipe off" the natural oscillations of the prefabricated rod led therethrough.

To minimize the tensile stresses which act on the prefabricated rod and may damage or even tear the latter, it is advantageous to control the rotational speed with which the magazine is turned additionally via the tensile force acting on the prefabricated rod. The prefabricated rod taken from the magazine may for example be deflected via a roller. Said roller may be mounted via a weight-sensitive or pressure-sensitive measuring means. Now, as soon as the tensile force acting on the prefabricated rod increases this is indicated by the weight-sensitive or pressure-sensitive measuring means which passes the measured value to a control means. The control means now supplies to the motor turning the magazine a control pulse which causes the motor and thus the magazine to turn faster, thereby reducing the tensile force loading the prefabricated rod. Conversely, the tensile force can of course also be intensified should the measuring means detect an inadmissible drop in the tensile force acting on the prefabricated rod. Such a configuration has the advantage that the prefabricated rod, which may have different transport properties, for example diameter, weight per unit length and the like, can always run into the format of the second rod-forming machine under identical conditions. This step guarantees a uniform quality of the method and apparatus product.

On the other hand, the tensile force acting on the rod can be controlled by deflecting the deflection roller to a greater or lesser extent.

Moreover, the discharging of the prefabricated rod may be made additionally more uniform by causing the discharging means to follow up within predetermined limit values in accordance with the filling height of the magazine or the distance between the guide and removal point. For this purpose, either the guide means is raised by a motor or lowered by a motor or alternatively the bottom of the magazine is vertically movable. To sense the filling height of the prefabricated rod, at specific heights sensors may be provided at the magazine and measure the instantaneous filling level. On the basis of the measured values a regulated motor coupled to the discharging or guide means can carry out the necessary adaptations to the filling level height.

To enable the magazine to be exchanged as rapidly as possible it is advantageous to provide the magazine with a coupling. This makes it possible when using quick-action couplings to shorten the times necessary for equipping the rod-forming machines with empty of full magazines.

For the rotational drive of a magazine in the charging and discharging it is advantageous to provide in each case at least one rotary table for both loading operations. Each rotary table should comprise the counter-coupling associated with the coupling at the magazine in order to be able to obtain the aforementioned advantage.

It is equally possible to provide instead of a rotary table with a coupling a drive shaft onto which the magazine for the charging and discharging is placed or plugged; the drive shaft should also have a counterpiece to the coupling at the magazine.

BRIEF DESCRIPTION OF THE DRAWINGS

The invention will be explained hereinafter in detail with the aid of some particularly advantageous embodiments and method variants with reference to the accompanying drawings from which further essential features and advantages of the invention will be apparent and in which.

DESCRIPTION OF THE PREFERRED EMBODIMENTS

It is first pointed out that the first rod-forming machine 20 and the second rod-forming machine 40 are substantially constructed as known from DE-OS 3,602,846.

Figure 1:
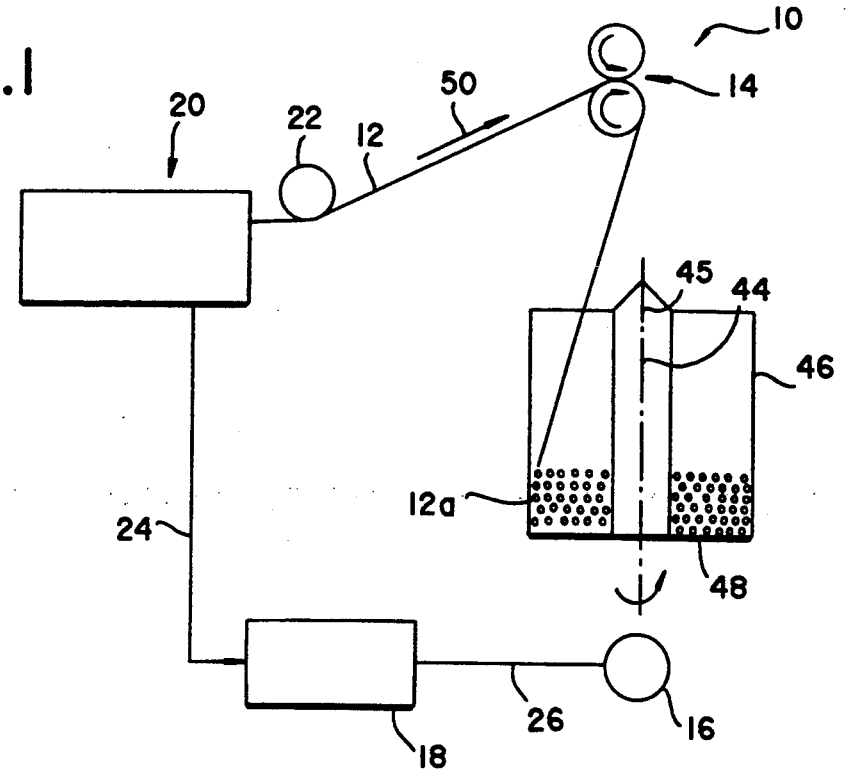
FIG. 1 shows a very simplified view of a first rod-forming machine, a charging means and a magazine.

In the illustration according to FIG. 1 the apparatus for carrying out in particular the method described is only partly shown. The reference numeral 20 denotes a first rod-forming machine which produces a preformed rod of a filling material and a first sheath. Means for transporting, lifting and depositing the preformed rod 12 into a magazine 10 are indicated by the reference numerals 22 and 14. These are essentially conveying rollers 22 and transport rollers or conveying rollers 14 for lifting and depositing the preformed rod 12 into the magazine 10.

The magazine 10 is a barrel-like container of which the storage capacity is defined towards the container interior by a wall 44 or a body 45 and towards the container exterior by a peripheral wall 46. The body 45 can be removed from the magazine 10. The spiral layers of the preformed rod 12 laid out in the magazine 10 are indicated by the reference numeral 12*a*. The bottom 48 of the magazine 10 is vertically movable. This makes it possible during the depositing operation of the preformed rod 12 in the magazine 10 to keep the deposition height or height difference between the charging means 14 and the instantaneous layer of the preformed rod constant. This possibility can also be utilized during the discharging.

A motor 16 controlled by a control means 18 via a control line 26 effects the rotational movement of the magazine 10 about its vertical axis. The speed with which the magazine 10 is rotated by the motor 16 is variable and depends on the production parameters of the rod-forming machine 20, which for evaluation and determination of the necessary rotational speed are transmitted via a data line 24 to the control means 18. The data used to determine the rotational velocity consist for example of the production rate with which the preformed rod 12 leaves the rod-forming machine 20 or with which the preformed rod 12 is transported and deposited, and the diameter of the preformed rod 12. Furthermore, the dimensions of the magazine 10 are also incorporated into the calculation of the instantaneously valid rotation speed.

The magazine 10 may be provided with a coupling which is not illustrated here and with which it can for example be deposited onto a rotary table which is provided with the counterpiece to the coupling of the magazine 10. The rotary table is driven by the motor 16. It is also possible to establish the mechanical and power connection between the motor 16 and the magazine 10 by a connecting shaft on which said coupling member is provided. Such couplings are preferably constructed as quick-action couplings.

In operation the preformed rod 12 leaves the rod-forming machine 20 in the direction of the arrow 50. As this is done appropriate measuring devices in the rod-forming machine 20 continuously transmit data on the production rate and production parameters of the preformed rod via the data line 24 to the control means 18. The preformed rod 12 is conveyed via one or more transport or conveying rollers 22 in the direction of the arrow 50 to the charging means 14. The preformed rod 12 may also be raised.

The rod 12 is thereafter lowered into the rotating magazine 10. In the magazine 10 the rod 12 is deposited spirally from the outside to the inside and thereafter from the inside to the outside, etc. The rotational speed of the magazine 10 is adapted so that the product of the rotational speed of the magazine 10 and its instantaneous deposition periphery is equal to the production rate or conveying rate with which the preformed roc 12 is made by the rod-forming machine 20 or transported from the latter to the magazine 10. The diameter of the preformed rod is also used to determine the instantaneously valid deposition radius; this may be done quite simply by addition or subtraction. It is also possible to take into account further additional safety distances between the individual rod convolutions of a layer.

Figure 2:
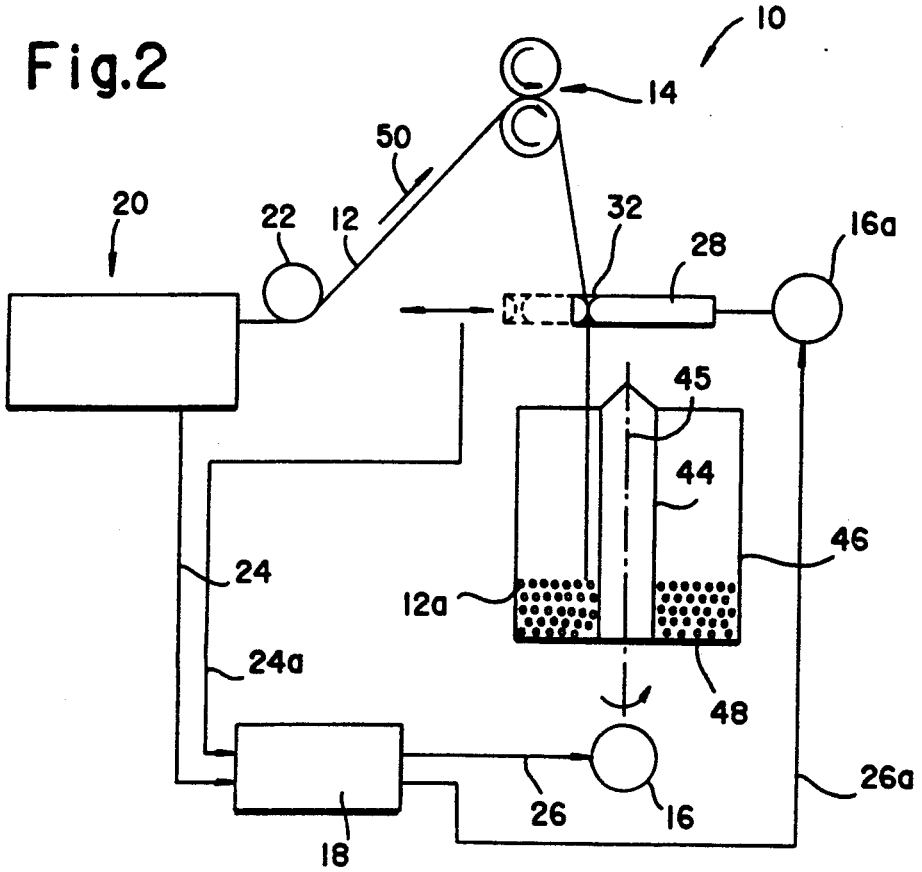
FIG. 2 shows an embodiment of the apparatus according to the invention with a charging means movable radially with respect to the magazine.

The embodiment shown in FIG. 2 includes all the essential features of the embodiment of FIG. 1. In addition, in this case an arm 28 is provided which is equipped with a guide 32. The arm 28 is displaceable in the radial direction of the rotation-symmetrical magazine 10 via a motor 16*a*. The displacement of the arm 28 and thus of the guide 32 is controlled in such a manner that the deposition of the preformed rod 12 can take place perpendicularly from above downwardly into the magazine 10. Via a dataline 24*a* the control 18 receives data on the instantaneous position of the guide 32 or the arm 28. The control means 18 is able to calculate the deposition radius in the magazine 10 theoretically valid at any instant from the data on the thickness of the rod 12 and the rotational speed as well as the dimensions of the magazine 10.

Particularly important here is on the one hand for the preformed rod 12*a* deposited in the magazine 10 to form layers which are as dense as possible but on the other hand to avoid any overlappings between adjacent rod convolutions. This is necessary in order to utilize as completely as possible the storage capacity of the magazine 10 and prevent tanglings of the spiral convolutions or the layers due to excessive distances between the spiral convolutions or layers. Faulty charging results here can lead to damage or even tearing of the preformed rod on subsequent discharging of the magazine 10.

The control pulses resulting form the calculation by the control means 18 are transmitted via a dataline 26*a* to the motor 16*a* which sets the instantaneously necessary position of the arm 28 or the guide 32.

Figure 3:
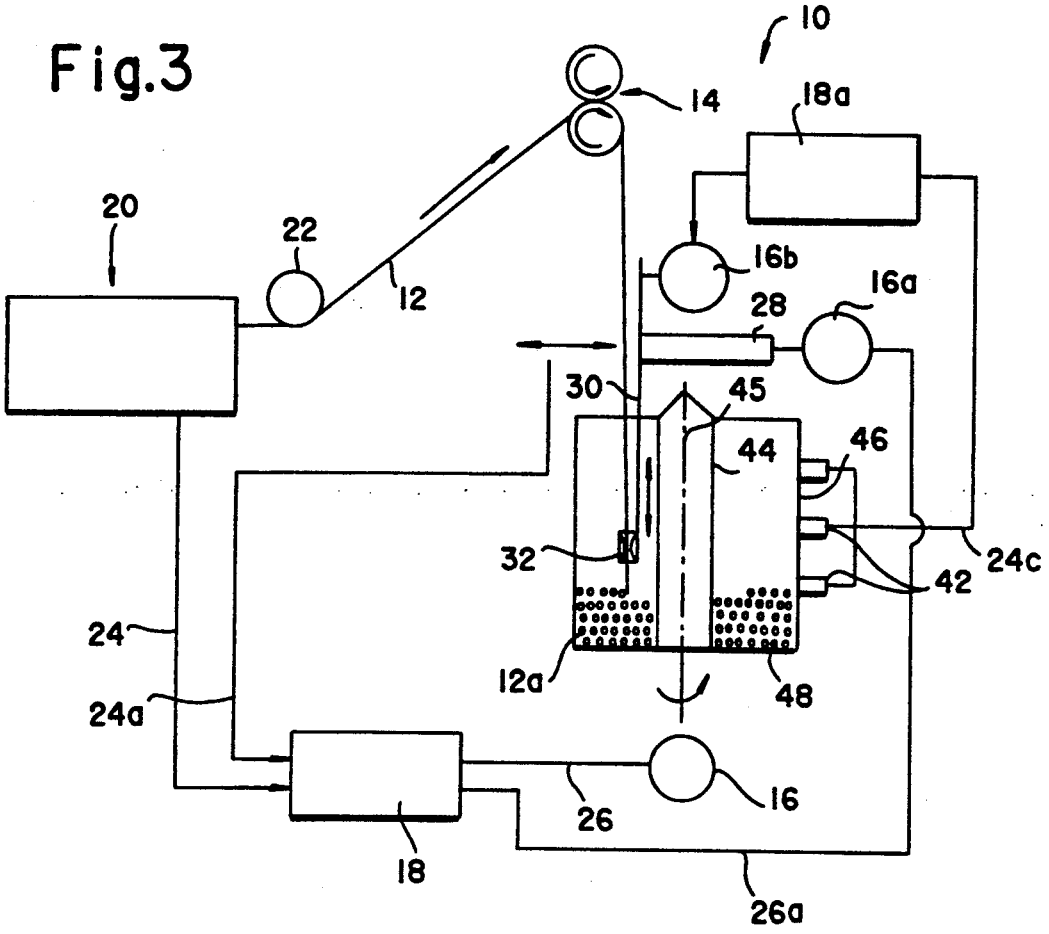
FIG. 3 shows a schematic view of an embodiment in which the charging means is additionally vertically movable.

The embodiment according to FIG. 3 exhibits all the essential features of the embodiments of FIG. 2 or FIG. 1. In addition, in this embodiment there is the possibility of changing the height of the guide 32. This change depends on the instantaneous filling height of the preformed rod 12*a* in the magazine 10. For determining the instantaneous filling height of the magazine 10 sensors 42 are provided at the outer wall 46 of said magazine 10. These may be contact sensors, field sensors, light barriers, and the like. The sensors pass their measuring signals via datalines 24*c* to a control means 18*a* (this function can also be fulfilled by the control means 18). The control means 18*a* emits control pulses to a motor 16*b* which moves the guide 32 up and down via a holding means 30 mounted on the arm 28. It is possible with this configuration to place the preformed rod 12 in the magazine 10 with even greater accuracy. It would also be conceivable to provide between the part 14 of the charging means and the guide 32 further guides or even a longer guide tube.

Generally, it may be said that the magazine 10, after being completely filled, can be replaced by an empty magazine 10. The magazines 10 can then be stored as required or alternatively passed to a second rod-forming machine 40 or to a discharging apparatus connected thereto.

Figure 4:
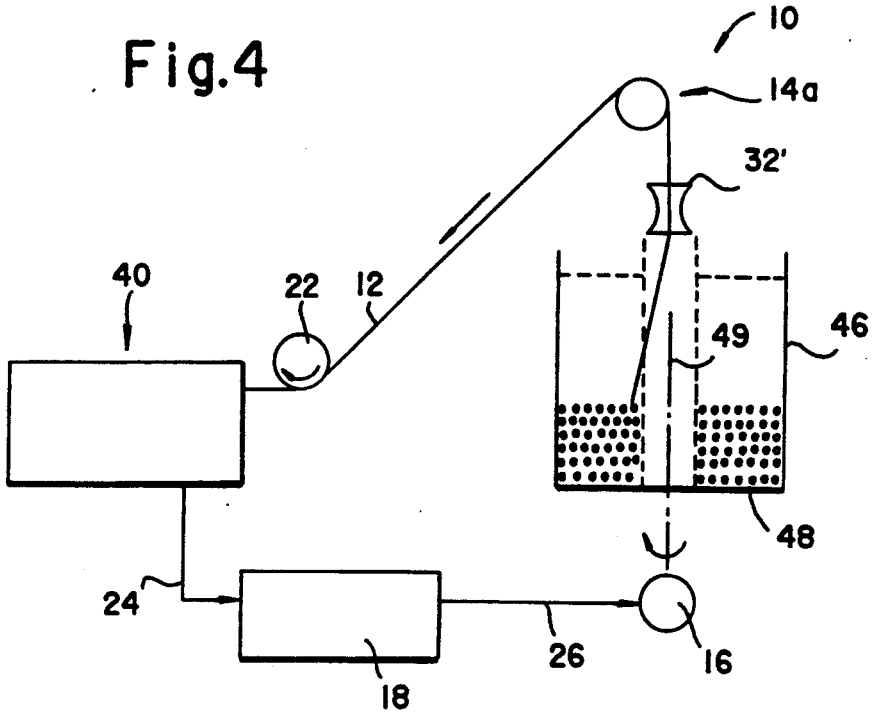
FIG. 4 shows an embodiment in which a partially filled magazine with a discharge means and a second rod-forming machine is illustrated.

The part of an apparatus for producing coaxial tobacco or filter rods illustrated in FIG. 4 includes a second rod-forming machine 40 in which the preformed rod 12 is provided with filter or smokable material and a further covering. For this purpose the preformed rod 12 is first removed from the magazine 10. The rotational speed here may be constant or variable.

The guide 32' of the discharge means is so configured that natural oscillations of the preformed rod 12 may be reduced. This is necessary because the rod 12 inherently contains the rotational movement of the magazine 10. This natural oscillation of the rod 12, which is spiral in form seen from above, is "wiped off" by a correspondingly formed guide 32' and thus almost eliminated. For this purpose the guide 32' is provided with a passage continuously tapering in the transport direction and arranged on the vertical central axis of the magazine 10. After undergoing a certain tapering, the passage can then widen again. The inner profile of the guide member 32' may also have a hyperbolic film or the like.

If a preformed rod is to be further processed in the rod-forming machine 40 the magazine 10 is coupled to the motor 16 and the end of the preformed rod 12 is threaded into the discharge means or into the rod-forming machine 40. The threading-in path leads through the guide 32', via the transport rollers 14*a*, 22 and finally into the second rod-forming machine 40. The second rod-forming machine 40 controls the rotational speed of the magazine 10 substantially via its processing rate by means of the control means 18 and the motor 16. Once the preformed rod 12 has been removed in its entire length from the magazine 10 the latter is uncoupled from the motor 16 and another filled magazine 10 is connected to the motor 16 for further processing of the preformed rod 12 stored therein and to the discharge means 32', 14a, 22 to be further processed in the rod-forming machine 40.

Figure 5:
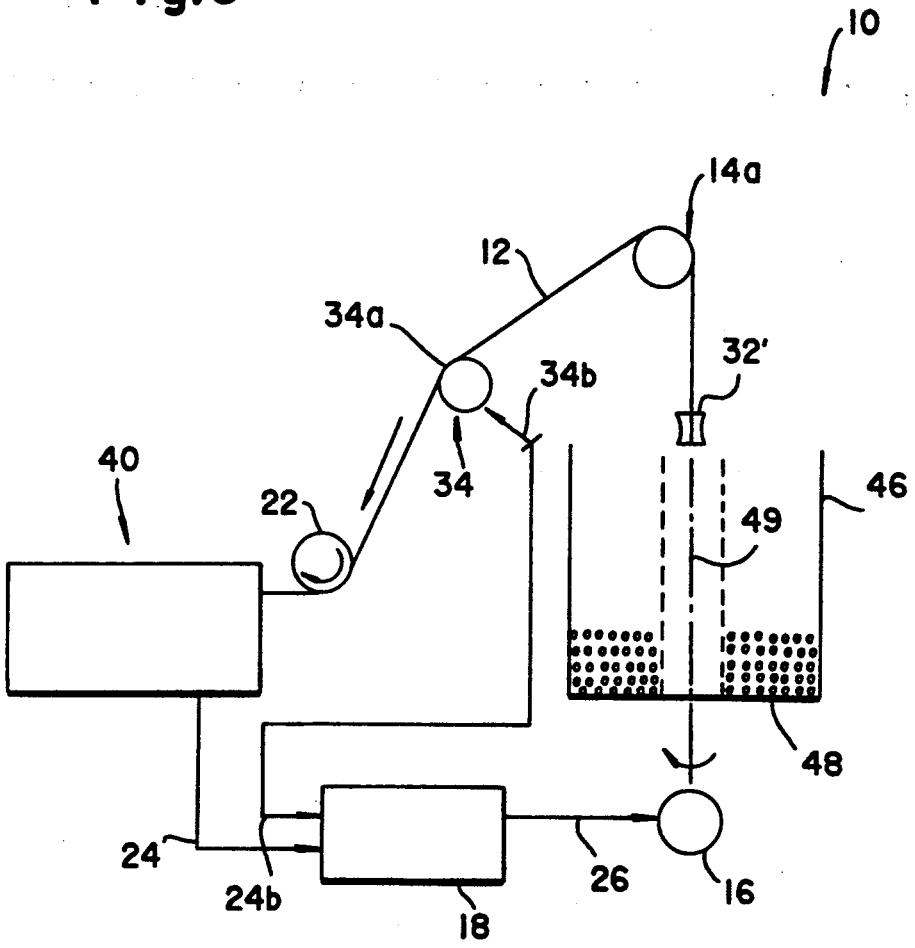
FIG. 5 shows the embodiment according to FIG. 4 with a measuring means for determining the tensile force acting on the preformed rod.

The embodiment illustrated in FIG. 5 corresponds substantially to the embodiment according to FIG. 4 and is equipped with a measuring means for detecting the tensile force acting on the preformed rod 12. The measuring means comprises a movable runner roller 34a which presses against a resilient member 34b acting as sensor. Said member 34b may register the pressure force with which the preformed rod 12 acts on the runner roller 34a. Since this pressure force of the rod 12 is proportional to the tensile force acting on the preformed rod 12 the tensile force can be detected. For as soon as the tensile force on the rod 12 exceeds a limit value depending on stability data of the preformed rod 12 the control means 18 passes control pulses to the drive motor 16, whereupon the magazine 10 is rotated with a higher speed and the preformed rod 12 thus relieved.

It is moreover also possible to supplement the measuring member 34b by a deflection member which in dependence upon the acceptable tensile force deflects the roller 34a either in the vertical direction to the conveying direction of the rod 12 or alternatively, should the tensile force become too small, with the possibility of the rod 12 sagging, increases the tensile force by a greater deflection of the roller 34a.

The control data necessary for this purpose are determined by the control 18.

Figure 6:
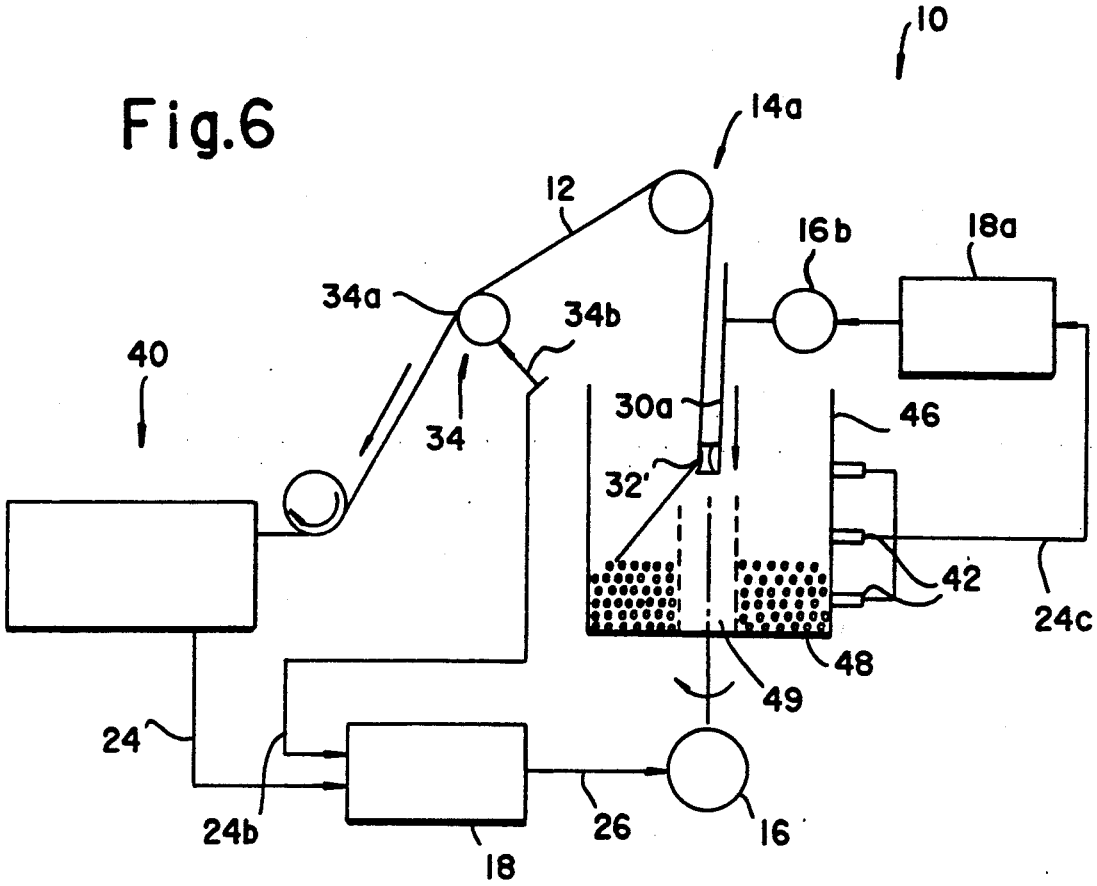
FIG. 6 shows the embodiment according to FIG. 5, the discharge means being additionally vertically movable and the magazine provided with sensors.

The embodiment illustrated in FIG. 6 comprises essentially the same features as the embodiments illustrated in FIGS. 4 and 5. However, in addition the embodiment according to FIG. 6 includes the possibility of vertically moving the guide 32' in order to ensure that the guide properties and thus the loads acting on the preformed rod 12 remain unchanged independently of the filling height of the magazine 10. To determine the filling height sensors 42 are mounted at various heights on the magazine 10. Alternatively, on the magazine 10 holes may be provided through which the sensors detect the filling height in the magazine. For this purpose, reflecting surfaces may be provided opposite said holes at the opposite wall of the magazine 10 and reflect the measuring beam of the sensors 42. If the sensors 42 receive a reflection signal, possibly from an additional light source, they pass a corresponding signal to the control 18a which therefore knows that at the level of the corresponding sensor or sensors 42 no spiral layers of the rod 12 are present. In this further development the sensors 42 may be mounted on a strip fixedly installed for example on the housing of the motor 16 and this has the advantage that it is not necessary to provide each individual magazine with sensors, therefore also avoiding problems with the handling of control lines, for example via wiping contacts. This function could also be fulfilled with a single sensor movable along the strip.

As already explained the sensors 42 pass up-to-date measured values on the instantaneous filling level of the magazine 10 via the control line 24c to the control means 18a. In the control means 18a control data are generated which cause a motor 16b to vertically move the guide 32' via a holder 30a with which the guide 32' is mounted on the motor 16b.

Figure 7:
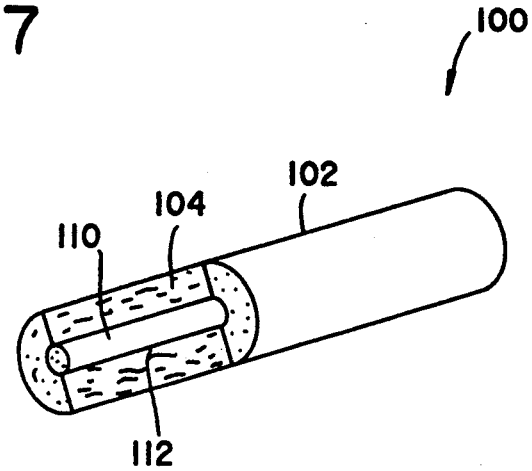
FIG. 7 is a perspective partial section of a tobacco or filter rod which has been made by the method according to the invention or the apparatus according to the invention.

The coaxial tobacco or filter rod shown in FIG. 7 and made by the method according to the invention or with the apparatus according to the invention is denoted generally by the reference numeral 100. Said tobacco or filter rod 100 consists of an inner rod 110 of filler material made in the first rod-forming machine 20. Said filling material is surrounded by a first covering 112 of for example a paper. The inner rod 110 is surrounded by filter or smokable material 104. Finally, an outer sheath of for example paper is present. The inner rod 110 is arranged coaxially in the outer rod.

It is pointed out in concluding that the efficiency with a constructional form according to the present invention can be increased in remarkable manner. Thus, the efficiency with the known direct coupling of the first rod-forming machine 20 to the second rod-forming machine 40 can be calculated as 60% if each of the two rod-forming machines 20, 40 operates with an efficiency of 80%.

In contrast, the indirect coupling according to the invention of the first rod-forming machine 20 to the second rod-forming machine 40 via the magazine 10 and charging and discharging means leads to a total efficiency of 75% although in the example given here the respective efficiency of the two rod machines is only 75%.

In a test arrangement the magazine 10 had an outer diameter of 1.25 m, an inner diameter of 0.4 m and a height of 1.0 m. In a filling degree (volume utilization) of about 55% a rod length of 11,000 m could be accommodated in the magazine 10. With a rod speed of 5 m/s (corresponding to 300 m/min) this filling degree permitted a production time in the rod-forming machine 40 of about 48 minutes.

For longer production times greater volumes are of course necessary for the magazines 10. However, this simultaneously increases the weight which the lower layers of the preformed rods 12 have to withstand. This could be counteracted by using magazines 10 which have for example the form of a cone truncated at a certain height and standing on its tip. This would make it possible to substantially reduce the pressure on the lower spiral layers of the rod 12a. At the same time, the volume of the magazine would be increased and the possible maximum further processing time in the rod-forming machine 40 lengthened. Alternatively, it is also possible to make the intermediate magazine in the form of a coil and wind the prefabricated rod thereon, subsequently again unwinding said rod.

We claim:

1. A method for producing coaxial tobacco or filter rods, wherein a) a first rod-forming machine forms a preformed rod from a strip-like first covering material and a stream of filling material; and b) a second rod-forming machine forms the coaxial tobacco or filter rod from the preformed rod, a strip-like second covering material, and a stream of filling material, wherein c) the preformed rod coming from the first rod-forming machine is intermediately stored before it is further processed in the second rod-forming machine.

2. A method according to claim 1, wherein the preformed rod is transported by transporting means from said first rod-forming machine to a storage magazine, then deposited in the magazine and subsequently removed from the magazine and supplied to the second rod-forming machine.

3. A method according to claim 2, wherein the storage magazine is a rotating magazine.

4. A method according to claim 2, wherein the preformed rod is deposited substantially in layers spirally from an inside of the magazine to an outside thereof in a radial direction outwardly and inwardly.

5. A method according to claim 2, further comprising the steps of:

providing deflection or conveying means comprising deflection rollers and/or transport rollers;

raising said preformed rod by said deflection or conveying means, before said preformed rod is conveyed to the magazine.

6. A method according to claim 2, wherein rotational speed of the magazine is controlled so that the preformed rod entering the magazine with constant production or conveying speed from the first production machine is laid out uniformly in the magazine independently of a radius on which the preformed rod is instantaneously deposited in the magazine.

7. A method according to claim 6, wherein a change of the rotational speed is controlled in dependence upon the diameter of the preformed rod.

8. A method according to claim 2, wherein the preformed rod is guided such that a depositing point thereof in the magazine corresponds to a theoretically calculated instantaneously valid point of a spiral in the magazine.

9. A method according to claim 2, wherein the preformed rod in the magazine 10 is adapted to its instantaneous filling height.

10. A method according to claim 2, wherein the respective uppermost layer of the spirally laid preformed rod is held at a predetermined height and wherein a bottom of the magazine is vertically movable.

11. A method according to claim 2, wherein the preformed rod is removed from the magazine via a discharge means.

12. A method according to claim 11, wherein the magazine is rotated with a substantially constant rotational speed.

13. A method according to claim 2, wherein natural oscillations of the preformed rod withdrawn from the magazine during the discharge operation are substantially eliminated in that the rod is removed via a guide provided above the magazine.

14. A method according to claim 13, wherein a distance between the guide and a removal point corresponds to predetermined limit values.

15. A method according to claim 3, further comprising the step of controlling a rotational speed of the rotating magazine when the preformed rod is being removed from the magazine and supplied to the second rod-forming machine, said rotational speed being controlled by a tensile force exerted on the preformed rod.

16. An apparatus for the production of a coaxial tobacco or filter rod, comprising a) first rod-forming means for producing a preformed rod of a strip-like covering material and a filling material and b) second rod-forming means for bringing together and processing the preformed rod with a strip-like second covering material and a stream of filter or smoking material to form the coaxial tobacco or filter rod, wherein c) a rotation-symmetrical magazine is disposed between the first rod-forming means and the second rod-forming means, for holding the preformed rod therein.

17. An apparatus according to claim 16, further comprising charging and discharging means for the charging and discharging of the magazine.

18. An apparatus according to claim 16, wherein the magazine is mounted rotatably about a longitudinal axis thereof and is rotatable via a drive shaft which engages on the longitudinal axis and is engaged by a drive motor.

19. An apparatus according to claim 16, wherein a deflection or conveying means is disposed between the first rod forming means and the second rod forming means, said deflection or conveying means comprising deflection rollers and/or transport rollers and is equipped with a drive means.

20. An apparatus according to claim 16, wherein a control means is provided which controls the deposition of the preformed rod in the magazine such that a rod production rate is independent of an instantaneous deposition location in the magazine, wherein the magazine is turned faster when the deposition is near a center of the magazine and slower in an outer region of the magazine.

21. An apparatus according to claim 20, wherein the control means controls the deposition of the preformed rod based on a diameter of the preformed rod.

22. An apparatus according to claim 16, wherein the magazine comprises a rotation-symmetrical removal body which is disposed on a longitudinal axis of the magazine.

23. An apparatus according to claim 16, wherein the charging means includes guide means for guiding the charging means to deposit the preformed rod on a deposition region predefined by the control means, the preformed rod being deposited on a spiral path.

24. An apparatus according to claim 16, wherein the charging means is mounted movably corresponding to an instantaneous filling height of the magazine.

25. An apparatus according to claim 16, wherein a bottom of the magazine is vertically movable.

26. An apparatus according to claim 17, wherein a guide is provided on the discharge means, said guide absorbing natural oscillations of the preformed rod.

27. An apparatus according to claim 17, wherein the discharge means includes measuring means for measuring the tensile force exerted on the preformed rod.

28. An apparatus according to claim 16, wherein the magazine is provided with a coupling.

29. An apparatus according to claim 16, wherein drivable rotation means, are provided onto which the magazine can be placed for charging or discharging.

30. An apparatus according to claim 29, wherein the drivable rotation means is provided with counterpieces to a coupling on the magazine.

* * * * *